US006489711B2

(12) United States Patent
Makita et al.

(10) Patent No.: US 6,489,711 B2
(45) **Date of Patent: *Dec. 3, 2002**

(54) SHADOW MASK FOR COLOR PICTURE TUBE MADE OF IRON-BASE MATERIAL HAVING PARTICULAR GRAIN SIZE NUMBER

(75) Inventors: Akira Makita, Tokyo (JP); Takahito Aoki, Tokyo (JP)

(73) Assignee: Dai Nippon Printing Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,986

(22) Filed: Apr. 30, 1999

(65) Prior Publication Data

US 2002/0053865 A1 May 9, 2002

(30) Foreign Application Priority Data

Apr. 30, 1998 (JP) ..... 10-121326

(51) Int. Cl.[7] ..... H01J 29/81; H01J 29/07
(52) U.S. Cl. ..... 313/402; 313/408
(58) Field of Search ..... 313/402, 403, 313/407, 408; 445/47; 148/310

(56) References Cited

U.S. PATENT DOCUMENTS

| | | | | |
|---|---|---|---|---|
| 5,562,783 A | * | 10/1996 | Inoue et al. | 148/310 |
| 5,605,582 A | | 2/1997 | Inoue et al. | 148/320 |
| 5,643,697 A | | 7/1997 | Baudry et al. | 430/5 |
| 5,716,252 A | * | 2/1998 | Van Den Berg et al. | 445/47 |
| 5,811,918 A | * | 9/1998 | Van Den Berg et al. | 313/402 |

FOREIGN PATENT DOCUMENTS

| | | |
|---|---|---|
| DE | 3642205 | 1/1988 |
| EP | 0-101-919 | 3/1984 |
| EP | 0-174-196 | 3/1996 |
| WO | WO 95/19636 | 8/1995 |

* cited by examiner

*Primary Examiner*—Nimeshkumar D. Patel
*Assistant Examiner*—Karabi Guharay
(74) *Attorney, Agent, or Firm*—Sughrue Mion, PLLC

(57) ABSTRACT

A shadow mask for a color picture tube that is made of an iron-base alloy material containing nickel and has a low coefficient of thermal expansion. The iron-base alloy material has 0.2% proof stress of from 220 to 300 N/mm$^2$. The grain size number measured in conformity to JIS G0551 is not more than 7.5. The degree of texture in each plane measured by X-ray diffraction method is not more than 20%. The difference between the degree of texture in each plane and that in any other plane is not more than 20%. The shadow mask is produced by press forming without undergoing annealing before the press forming.

1 Claim, 1 Drawing Sheet

Figure
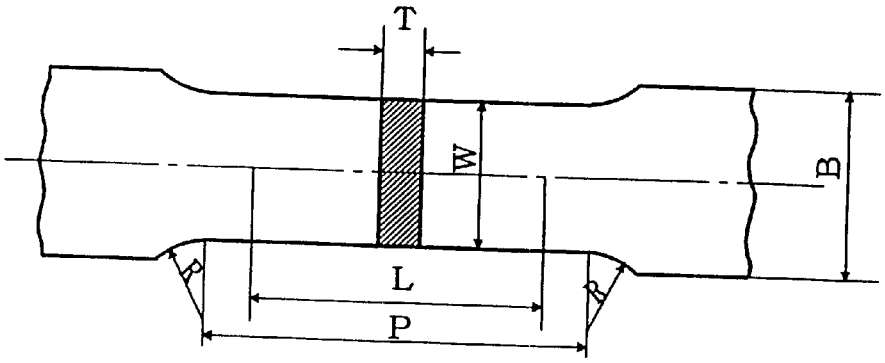

SHADOW MASK FOR COLOR PICTURE TUBE MADE OF IRON-BASE MATERIAL HAVING PARTICULAR GRAIN SIZE NUMBER

BACKGROUND OF THE INVENTION

The present invention relates to a shadow mask for a color picture tube for use in color television and computer color displays.

In color picture tubes for color television and color displays, a shadow mask formed from a metal sheet provided with a large number of small holes is used so that electron beams are applied to predetermined phosphors. Because accelerated electrons also collide against portions of the shadow mask other than the apertures, the shadow mask is heated and distorted by thermal expansion. This may cause the electron beams to be gradually displaced relative to the phosphor screen, resulting in color shift in the colored image.

Accordingly, nickel-iron alloys having a low coefficient of thermal expansion are used in place of low-carbon steel sheets conventionally used. Among them, Invar, which is a nickel-iron alloy containing 36% by weight of nickel, is widely used.

A shadow mask made of a nickel-iron alloy is manufactured as follows. For example, an ingot produced by melting alloy components prepared in a predetermined ratio is hot-rolled to a predetermined thickness and then subjected to cold rolling, annealing, etc., thereby producing a sheet. Then, the sheet is coated with a resist, exposed in a pattern for forming predetermined apertures, and subjected to etching to form apertures. In this way, a shadow mask original sheet is produced.

To attach the shadow mask original sheet to a color picture tube, the shadow mask original sheet needs to be formed by pressing in conformity to the inner configuration of the color picture tube. However, the shadow mask original sheet is inferior in press formability. Therefore, in order to improve the press formability, the shadow mask original sheet is annealed in a reducing atmosphere at a temperature of the order of from 700° C. to 1,000° C. Thereafter, the shadow mask original sheet is pressed and then heat-treated in an oxidizing atmosphere to form an oxide film on the surface in order to prevent rusting of the shadow mask and to reduce undesired reflection occurring when electron beams collide against the shadow mask. Thus, the desired shadow mask is obtained.

However, the shadow mask original sheet annealing process not only increases the number of process steps for production of a color picture tube but also involves problems such as undesirable sticking of a shadow mask original sheet to another and distortion due to nonuniformity of heat treatment, thus causing the image display quality of the color picture tube to be degraded.

Under these circumstances, JP 5065598A proposes a material for a shadow mask that makes it unnecessary to perform annealing before press forming by setting the proof stress and elongation of a shadow mask original sheet made of a nickel-iron alloy to values within predetermined ranges, respectively.

However, it is impossible to obtain a shadow mask having satisfactory characteristics simply by setting the proof stress and elongation to predetermined values.

An object of the present invention is to provide a shadow mask of superior characteristics that does not need the annealing process for improving the press formability after the aperture-forming process.

BRIEF DESCRIPTION OF THE DRAWINGS

The single FIGURE is a diagram illustrating a test piece used in a tensile test on the shadow mask for a color picture tube according to the present invention.

SUMMARY OF THE INVENTION

The present invention provides a shadow mask for a color picture tube that is made of an iron-base alloy material containing nickel and has a low coefficient of thermal expansion. The grain size number of the iron-base alloy material measured by a grain size measuring method defined by ASTM E112 (JIS G0551) is not more than 7.5.

The iron-base alloy material has a 0.2% proof stress in the range of from 220 to 300 N/mm$^2$.

The degree of texture in each plane of the iron-base alloy material measured by X-ray diffraction method is not more than 20%, and a difference between the degree of texture in each plane and that in any other plane is not more than 20%.

The iron-base alloy material is press-formed without carrying out annealing after it has been provided with apertures in a predetermined pattern.

In addition, the present invention provides a shadow mask for a color picture tube that is made of an iron-base alloy material containing nickel and has a low coefficient of thermal expansion. The iron-base alloy material has a 0.2% proof stress in the range of from 220 to 300 N/mm$^2$. The grain size number measured according to ASTM E112 (JIS G0551) of the iron-base alloy material is not more than 7.5. The degree of texture in each plane measured by X-ray diffraction method is not more than 20%. The difference between the degree of texture in each plane and that in any other plane is not more than 20%. The iron-base alloy material is capable of being press-formed without undergoing annealing after it has been provided with apertures in a predetermined pattern.

DESCRIPTION OF THE PREFERRED EMBODIMENT

The present invention is based on the finding that a shadow mask having excellent characteristics can be produced without carrying out annealing process before press forming by using a material having a specific value of proof stress and a predetermined grain size number and further a predetermined value for the degree of texture measured by X-ray diffraction method and having no anisotropy for each plane as a metal sheet made of a nickel-iron alloy for a shadow mask.

A nickel-iron alloy used for the shadow mask according to the present invention contains from 35.0% to 37.0% by weight of nickel. The nickel-iron alloy may contain chromium as a metallic element other than nickel.

A metal sheet used for the shadow mask according to the present invention can be produced as follows. Alloy components prepared in a predetermined ratio are melted and cast to obtain an ingot. The ingot is hot-rolled to a predetermined thickness and then repeatedly subjected to cold rolling and annealing.

A metallic material used for the shadow mask according to the present invention has the following properties. Regarding 0.2% proof stress, which is proof stress for 0.2% elongation measured by the metallic material testing method defined by ISO 6892 (JIS Z2241), it is preferably within the range of 220 to 300 N/mm$^2$. The austenite grain size number measured by the grain size measuring method defined by ASTM E112 (JIS G0551) is preferably not more than 7.5.

The degree of texture measured by X-ray diffraction method is preferably not more than 20% in each plane. It is also preferable that the maximum difference in the degree of texture among the planes should be not more than 20%, and thus there should be no anisotropy. If the degree of crystal orientation is high, directionality occurs during press forming and makes it impossible to perform uniform press forming.

The present invention will be described below by way of examples.

EXAMPLE 1

An iron-base metallic material containing 36% by weight of nickel was melted and cast. The resulting ingot was hot-rolled and then repeatedly subjected to cold rolling and annealing to produce a nickel-iron alloy sheet with a thickness of 0.13 mm.

The nickel-iron alloy sheet thus obtained was coated at both sides thereof with a water-soluble casein resist. After drying, the resists on the two sides of the sheet stock were patterned by exposure using a pair of glass dryplates having obverse and reverse patterns drawn thereon, respectively. Next, hardening and baking processes were carried out. Thereafter, the patterned resist surfaces were sprayed with a ferric chloride solution having a temperature of 60° C. and a specific gravity of 48° Be (Baume degree of heavy liquid) as an etching liquid from a spray nozzle to perform etching. After the etching process, rinsing was carried out, and the resist was removed with an alkaline aqueous solution, followed by washing and drying to produce a shadow mask original sheet.

The tensile strength, 0.2% proof stress, elongation, hardness and grain size number of the obtained shadow mask original sheet were measured.

The tensile strength and 0.2% proof stress were measured by the tensile testing method defined by ISO 6892 (JIS Z2241) using a test piece shown in the FIGURE.

In the FIGURE, the length of each portion is as follows:

L (gauge length): 50 mm

P (parallel length): 60 mm

R (radius of fillet): 20 mm

T (thickness): thickness of material

B (gripped ends): 30 mm

The hardness was measured in terms of Vickers hardness (0.3 kg). The grain size number was measured in terms of the austenite grain size number defined by ASTM E112 (JIS G0551). The results of the measurement are shown in Table 1 below.

The degree of texture for each plane direction was measured. The results of the measurement are shown in Table 2 below. The maximum difference in the degree of texture is also shown in Table 2.

Furthermore, each shadow mask original sheet obtained was press-formed by using a press-forming die for a 17-inch color picture tube. A shadow mask original sheet that was formed exactly to the configuration of the die was judged to be of good formability. A shadow mask original sheet that was not formed to the configuration of the die was judged to be of bad formability. A shadow mask original sheet that was deformed or broken to become unusable as a shadow mask was also judged to be of bad formability.

COMPARATIVE EXAMPLE 1

A nickel-iron alloy sheet having a thickness of 0.13 mm was produced in the same way as in Example 1 except that the hot rolling, cold rolling and annealing conditions were changed.

After patterns for etching had been formed on both sides of the nickel-iron alloy sheet thus obtained, etching was carried out, and then the nickel-iron alloy sheet was subjected to press forming at 200° C.

Various properties were measured in the same way as in Example 1. The results of the measurement are shown in Table 1.

In addition, the ratio and the degree of texture were measured for each of 7 plane directions. The results of the measurement are shown in Table 2.

COMPARATIVE EXAMPLE 2

A shadow mask original sheet obtained from a material having a tensile strength of 650 N/mm$^2$ and an elongation of 2% was annealed by holding the sheet at 810° C. in a hydrogen-containing nitrogen atmosphere for 20 minutes. Thereafter, the shadow mask original sheet was subjected to press forming at 200° C.

The results of measurements made in the same way as in Example 1 are shown in Table 1.

In addition, the degree of texture for each plane direction was measured. The results of the measurement are shown in Table 2.

TABLE 1

| | Tensile strength (N/mm$^2$) | 0.2% proof stress (N/mm$^2$) | Elongation (%) | Hardness | Grain size No. | Formability |
|---|---|---|---|---|---|---|
| Example 1 | 443 | 275 | 32 | 123 | 7.5 | good |
| Comp. Ex. 1 | 450 | 272 | 31 | 123 | 8.0 | bad |
| Comp. Ex. 2 | 465 (650) | 305 | 30 (2) | 129 (200) | 8.5 | bad |

In Table 1, the numerals in the parentheses are the values before the annealing process.

TABLE 2

| | Plane direction, 7 planes ratio and degree of texture | | | | | | | Maximum |
|---|---|---|---|---|---|---|---|---|
| | (111) | (200) | (220) | (311) | (331) | (420) | (422) | difference |
| Example 1 | 12 | 16 | 15 | 16 | 14 | 14 | 13 | 4 |
| Comp. Ex. 1 | 12 | 38 | 12 | 11 | 10 | 9 | 8 | 30 |
| Comp. Ex. 2 | 13 | 20 | 18 | 15 | 13 | 12 | 9 | 11 |

The shadow mask for a color picture tube according to the present invention is produced by using a nickel-iron alloy having excellent press formability. Therefore, the shadow mask original sheet can be formed exactly to the configuration of the press forming die without carrying out heat treatment before the press forming process. In addition, it is possible to obtain a high-quality color picture tube that exhibits superior characteristics.

What we claim is:

1. A shadow mask for a color picture tube that is made of an iron-base alloy material containing nickel and has a low coefficient of thermal expansion, wherein a grain size number of said iron-base alloy material measured by a grain size measuring method defined by ASTM E112 (JIS G0551) is not more than 7.5, wherein said iron-base alloy material is press-formed without carrying out annealing after it has been provided with apertures in a predetermined pattern, wherein said iron-base alloy material has a 0.2% proof stress in a range of from 220 to 300 $N/mm^2$, and wherein a degree of texture in each plane of said iron-base alloy material measured by X-ray diffraction method is not more than 20%, and a difference between the degree of texture in each plane and that in any other plane is not more than 20%.

* * * * *